US010006220B2

(12) United States Patent
Lee

(10) Patent No.: US 10,006,220 B2
(45) Date of Patent: Jun. 26, 2018

(54) SUPPORT SYSTEM AND STRUCTURE SUPPORTED THEREBY

(71) Applicant: Damian Kevin Lee, Preston (AU)

(72) Inventor: Damian Kevin Lee, Preston (AU)

( * ) Notice: Subject to any disclaimer, the term of this patent is extended or adjusted under 35 U.S.C. 154(b) by 49 days.

(21) Appl. No.: 15/328,915

(22) PCT Filed: Jul. 29, 2015

(86) PCT No.: PCT/AU2015/000444
§ 371 (c)(1),
(2) Date: Jan. 25, 2017

(87) PCT Pub. No.: WO2016/015087
PCT Pub. Date: Feb. 4, 2016

(65) Prior Publication Data

US 2017/0211289 A1 Jul. 27, 2017

(30) Foreign Application Priority Data

Jul. 29, 2014 (AU) ..... 2014902930
Jul. 29, 2014 (AU) ..... 2014902931
Nov. 21, 2014 (AU) ..... 2014904723

(51) Int. Cl.

| | |
|---|---|
| ***F16M 13/00*** | (2006.01) |
| ***E04H 12/22*** | (2006.01) |
| ***E04H 17/22*** | (2006.01) |
| ***E01F 13/02*** | (2006.01) |
| ***E04H 17/14*** | (2006.01) |

(52) U.S. Cl.
CPC ..... *E04H 12/2269* (2013.01); *E01F 13/022* (2013.01); *E04H 12/2238* (2013.01); *E04H 12/2246* (2013.01); *E04H 17/1421* (2013.01); *E04H 17/22* (2013.01)

(58) Field of Classification Search
USPC ..... 248/529
See application file for complete search history.

(56) References Cited

U.S. PATENT DOCUMENTS 4,787,603 A * 11/1988 Norton ..... A01K 3/00 119/513
5,484,225 A * 1/1996 Warner ..... E01F 9/692 116/63 C (Continued)

FOREIGN PATENT DOCUMENTS

AU 2012203098 12/2012

*Primary Examiner* — Monica E Millner
(74) *Attorney, Agent, or Firm* — Galbreath Law Offices, P.C.; John A. Galbreath

(57) ABSTRACT

A weighted support assembly for supporting an upright post. The support assembly comprises: —a base frame comprising:—an elongate base member attached to the post and extending outwards from the post; and —a plurality of upright elongate members ascending from the base member; —a plurality of weights stacked in layers upon the base member; and —a top frame comprising:—an elongate top member attached to the post and extending outwards from the post above the base member; and —a plurality of elongate members descending from the top member. The ascending members engage telescopically with corresponding said descending members, and each said weight defines a hole therethrough which is penetrated by at least one of said ascending or descending members.

11 Claims, 5 Drawing Sheets

(56) References Cited

U.S. PATENT DOCUMENTS

| | | | | |
|---|---|---|---|---|
| 5,860,386 | A * | 1/1999 | Schwab | B60Q 7/00 116/63 C |
| 6,517,280 | B2 * | 2/2003 | Carter | E01F 13/02 256/13.1 |
| 6,572,059 | B1 * | 6/2003 | Chapman | F16M 11/18 248/129 |
| 7,523,715 | B2 * | 4/2009 | Mettler | A47B 23/042 116/63 R |
| 7,631,409 | B2 * | 12/2009 | Dehlsen | E04H 12/2238 256/24 |
| 8,579,262 | B2 * | 11/2013 | Sadinsky | E04H 17/22 256/26 |
| 2006/0220318 | A1 * | 10/2006 | Law | F41J 1/10 273/407 |
| 2007/0170411 | A1 * | 7/2007 | Ribak | E01F 13/022 256/32 |
| 2014/0145046 | A1 * | 5/2014 | Layne | E04H 12/2238 248/188.1 |

* cited by examiner

SUPPORT SYSTEM AND STRUCTURE SUPPORTED THEREBY

TECHNICAL FIELD

This invention concerns an improvement to the counterweights and apparatus that are used to support erected temporary fences, hoardings and signs, and in particular temporary hoardings or sheet panels used for wind protection or to mount signage or advertising where such hoardings or sheet panels represent significant additional wind loading compared to an open mesh fence.

BACKGROUND

Temporary or short term fencing and hoarding is commonplace on building sites and shopping centres and is erected usually around the site perimeter to provide security from intruders and to prevent unauthorized entry. In many applications temporary fencing comprises a footing, usually made from concrete into which poles are inserted and wire, which is most commonly open weave mesh, strung between the poles to provide a secure fence enclosure. The footings are usually simply placed on the ground around the site at appropriate intervals and the poles simply inserted. This allows rapid erection of the temporary fence.

A hoarding provides greater visual screening than a fence but has the disadvantage of carrying a greater wind loading. In a situation where hoardings are to be attached to a temporary fence, additional mass of the concrete footing is required to ensure the fence will not topple in the case of extreme wind gusts. Extra mass footings are now mandated by engineering standards and building codes to ensure safety in temporary fences designed that carry hoardings.

One means to ensure temporary fences and hoardings meet appropriate standards is to bury the concrete base supports into the ground or to make on-site poured concrete footings. However such provisions are both expensive and time consuming, and sometimes impractical on a finished surface or internal building location.

Systems exist for retaining hoarding posts by means of weights placed onto feet attached to the bottoms of the posts. An example is described in Australian patent application no. 2012203098. However the components of that system are relatively complex and expensive to manufacture. The upstanding member in the support assembly has a specific size to the height of the stack of weights and the locking arrangement and the weights above the weights protrudes in an ungainly manner. The locking arrangement can also be readily removed by unauthorized personnel which could render the structure unsafe.

An aim of some embodiments of the present invention is to provide relocatable ground mounted concrete footings and support assemblies which can be used for temporary fencing and hoardings and that meet the appropriate standards for safety and engineering requirements, but which at the same time are easy to place and do not require any burying of the footings or the use of extra mass concrete pouring.

SUMMARY OF INVENTION

In one aspect the invention provides a weighted support assembly for supporting an upright post, said support assembly comprising:

a base frame comprising:

an elongate base member attached to the post and extending outwards from the post; and a plurality of upright elongate members ascending from the base member;

a plurality of weights stacked in layers upon the base member; and a top frame comprising:

an elongate top member attached to the post and extending outwards from the post above the base member; and a plurality of elongate members descending from the top member;

wherein:

said ascending members engage telescopically with corresponding said descending members, and each said weight defines a hole therethrough which is penetrated by at least one of said ascending or descending members.

In another aspect the invention provides a temporary hoarding, sign or fence structure comprising a plurality of upright posts connected by a plurality of generally horizontal rails where attached to each post is a weighted support assembly according to the definition immediately above.

In a further aspect the invention provides a method of erecting a temporary structure which includes the steps of:

positioning a plurality of weighted support assemblies each as defined above, securing a post to each respective said base frame and top frame, and fastening structural components to said posts.

The top member preferably lies against the upper layer of said layers of weights. Preferably said weights are stacked with the top of an underlying said weight nesting into the base of a respective weight immediately above.

Preferably the extent of said telescopic engagement is such that a layer of weights may be added or removed from said stack to create a new upper layer of weights while still providing said telescopic engagement and for the top member to bear upon said new upper layer of weights.

Preferably one end of said top frame comprises a hollow section end portion adapted to slide along said post. Preferably the elongate top member is releasably fastened rigidly to the post.

Preferably the elongate base member is fastened rigidly to the post.

Preferably the post comprises a square or rectangular hollow section steel member and one end of said base frame has a corresponding square or rectangular hollow section end portion which can slide along said post. Preferably the end portion is fastened to the post.

BRIEF DESCRIPTION OF DRAWINGS

In order that the invention may be more fully understood there will now be described, by way of example only, preferred embodiments and other elements of the invention with reference to the accompanying drawings where.

DESCRIPTION OF EMBODIMENTS

Figure 1:
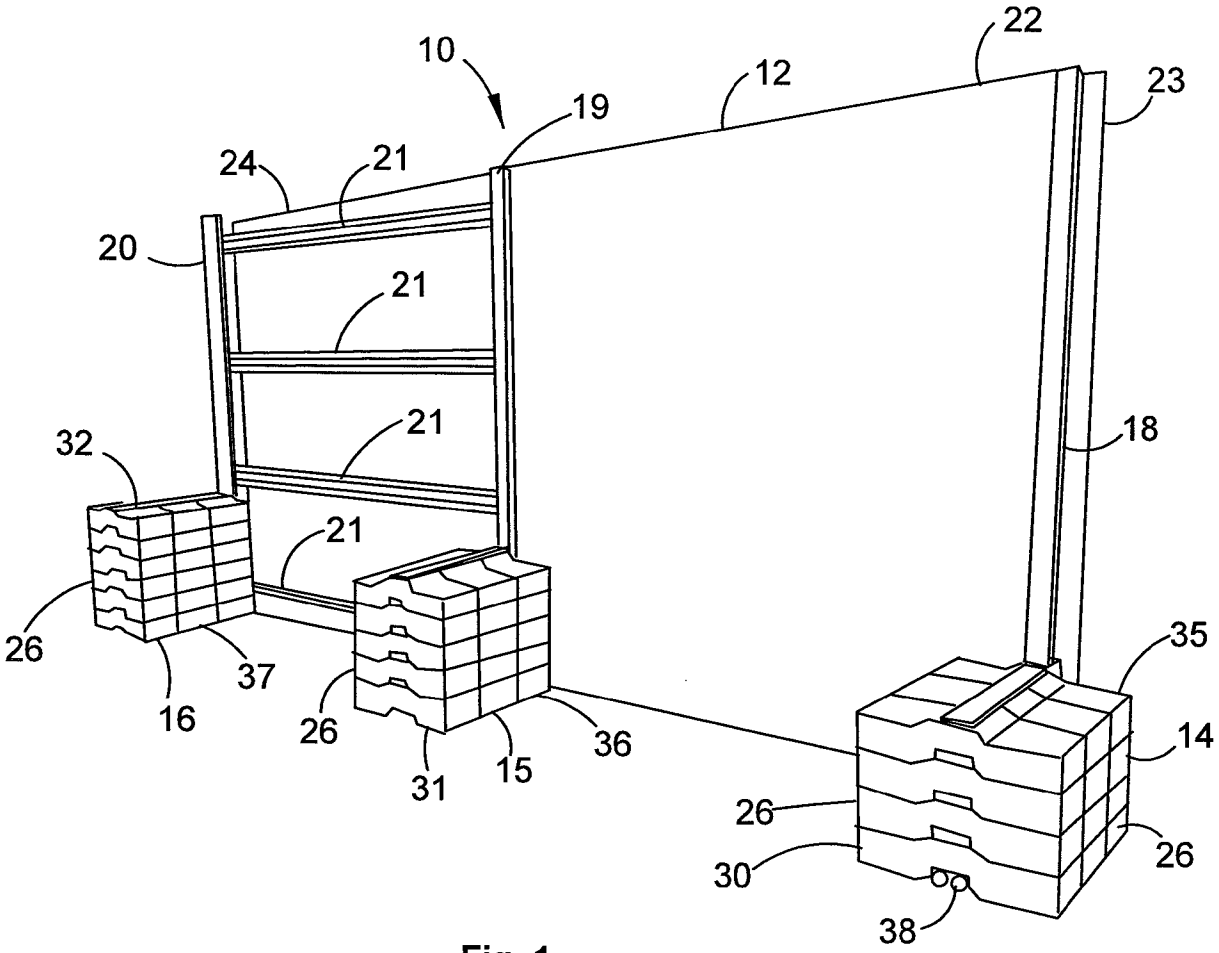
FIG. 1 is a view of a structure including a support system according to a first embodiment of the present invention.

The hoarding structure 10 in FIG. 1 is portion of a partially completed hoarding which is shown unfinished and incorporating a variety of components in order to better illustrate the invention. The structure includes a wall portion 12 and three weighted support assemblies 14, 15 and 16.

The wall portion 12 has three upright posts 18, 19 and 20 made of square hollow section tubular galvanized steel and four horizontal rails 21 extending between the posts. The rails 21 are a galvanized steel top hat section fastened by screws 17 to the posts. Cladding panels 22, 23 and 24 of plywood are fastened by screws 25 to the rails 21. In FIG. 1 a fourth panel is removed in order to show the underlying wall structure. On one side of the wall 12 the panels 23 and 24 are spaced from the posts by the depth of the rails 21. On the other side of the wall the posts 18 and 19 protrude beyond the outer face of the panel 22.

The hoarding 10 rests on a concrete surface and is retained in position by three weighted support assemblies 30, 31 and 32 each of which comprises a base frame 33, a top frame 34 and a stack of weights 26. The respective stacks 35, 36 and 37 form footings for each respective assembly and are shown with different numbers of weights in order to illustrate the adaptability of the invention.

Figure 2:
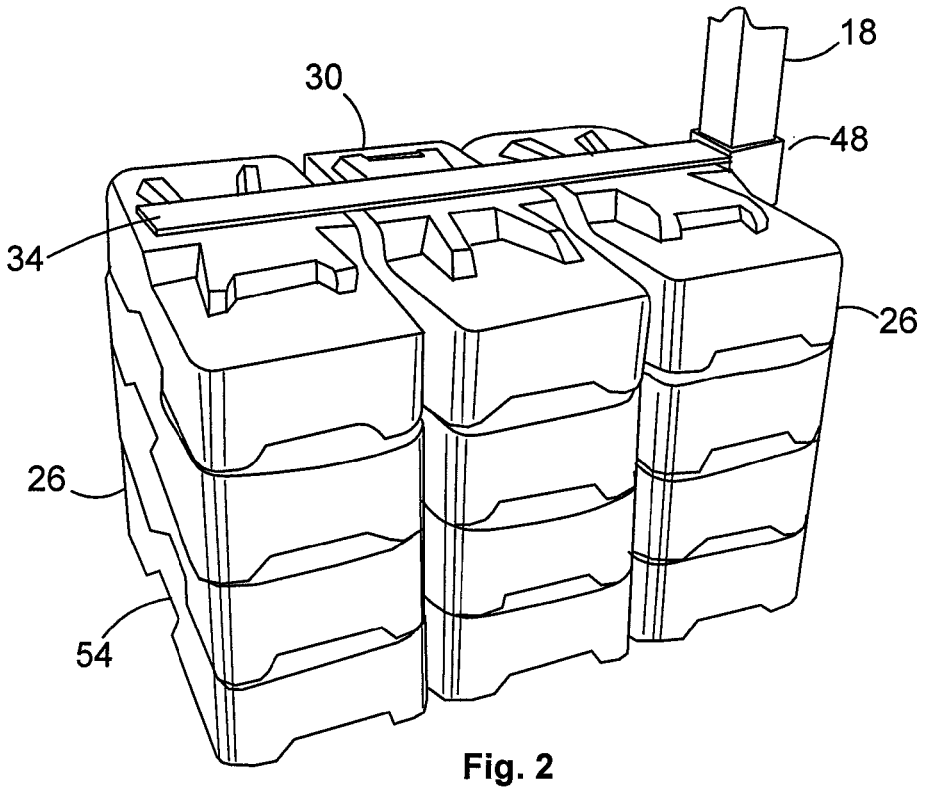
FIG. 2 is a view of portion of the structure shown in FIG. 1.

Each base frame 33 consists of an elongate base member 38, three upright members 40, and a fastening sleeve 42 attached to one end of the base member 38. The base member 38 consists of two lengths of 61 mm diameter steel pipe welded side by side. Each upright member 40 is a length of 61 mm diameter pipe welded at right angles to the base member. The sleeve 42 is a short length of square hollow section tube sized to be a loose sliding fit around the respective post 18 as shown in FIG. 2.

Each top frame 34 consists of an elongate top member 44 of flat steel, three descending elongate members 46 and a fastening sleeve 48 attached to one end of the top member 44. Each elongate member 46 in use hangs down, or descends, from the top member 44 and is a length of square hollow section steel welded to and at right angles to the top member 44. The fastening sleeve 48 is a short length of square hollow section tube sized to be a loose sliding fit around the post 18.

The square section descending members 46 are sized to be a loose sliding fit within the circular section ascending members 40 as in use they engage telescopically. An advantage of using square section instead of circular section tube to slide within the circular pipe members 40 is that the sliding action is smoother and less prone to binding.

Figure 3:
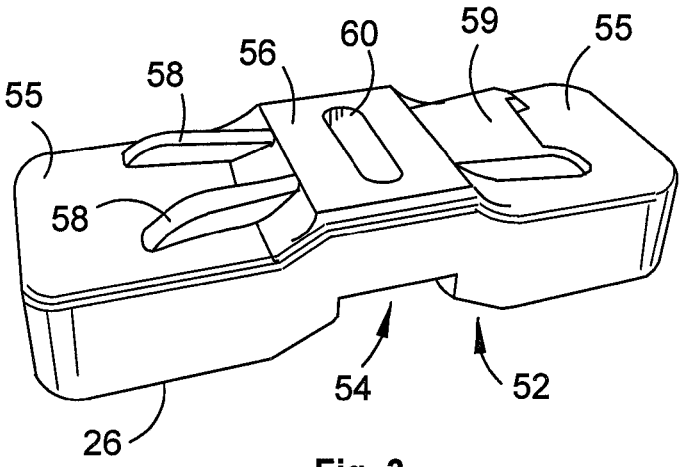
FIG. 3 shows a weight of the type included in the structure shown in FIG. 1.
Figure 4:
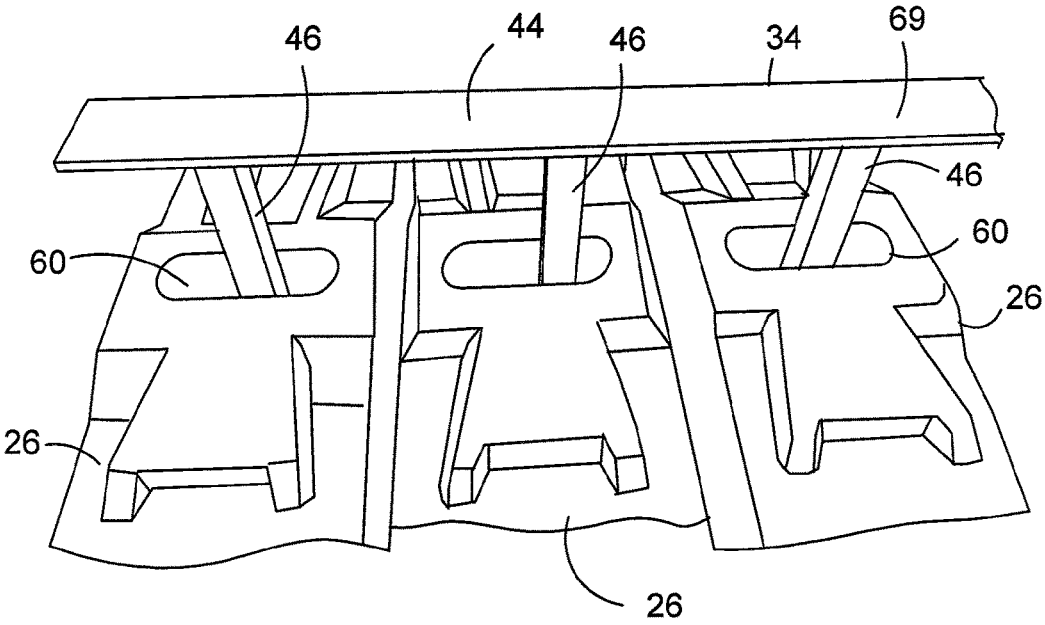
FIG. 4 is a view of portion of the structure shown in FIG. 2 but with some of the weights removed.
Figure 6:
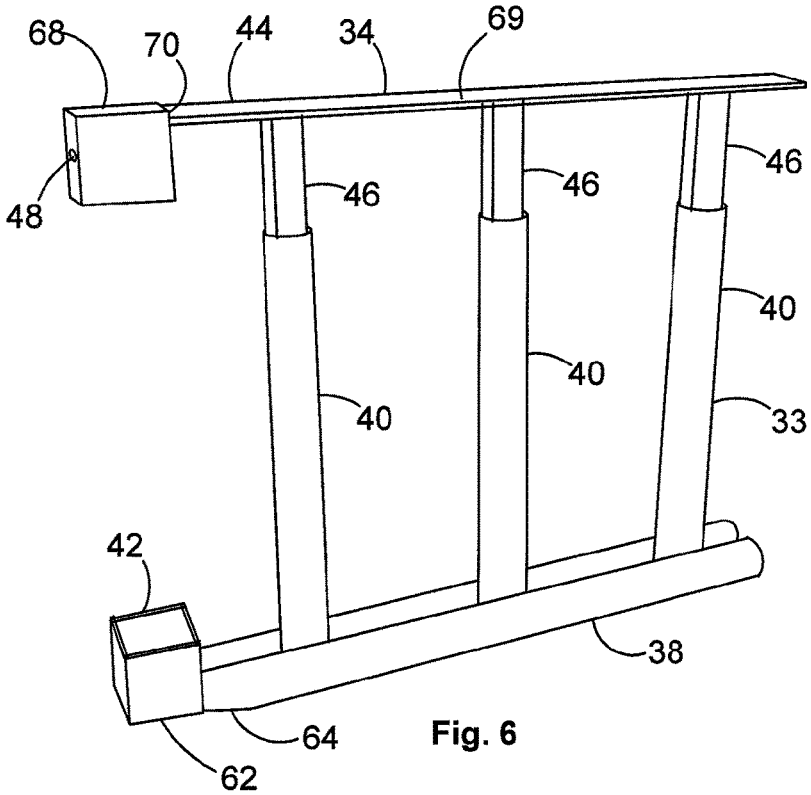
FIG. 6 is a view of some of the components seen in FIG. 5 from a different angle.
Figure 5:
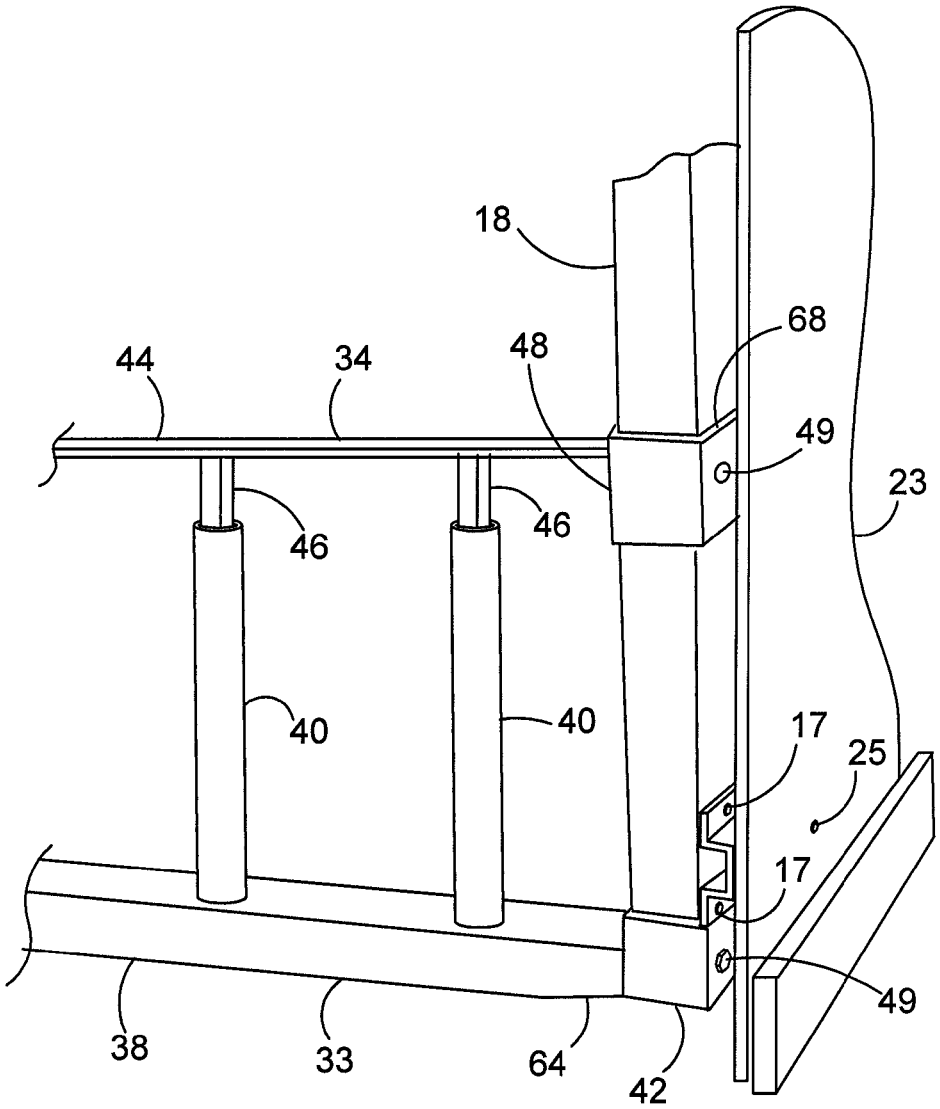
FIG. 5 is a view of the structure portion shown in FIG. 2 but with all of the weights removed.
Figure 7:
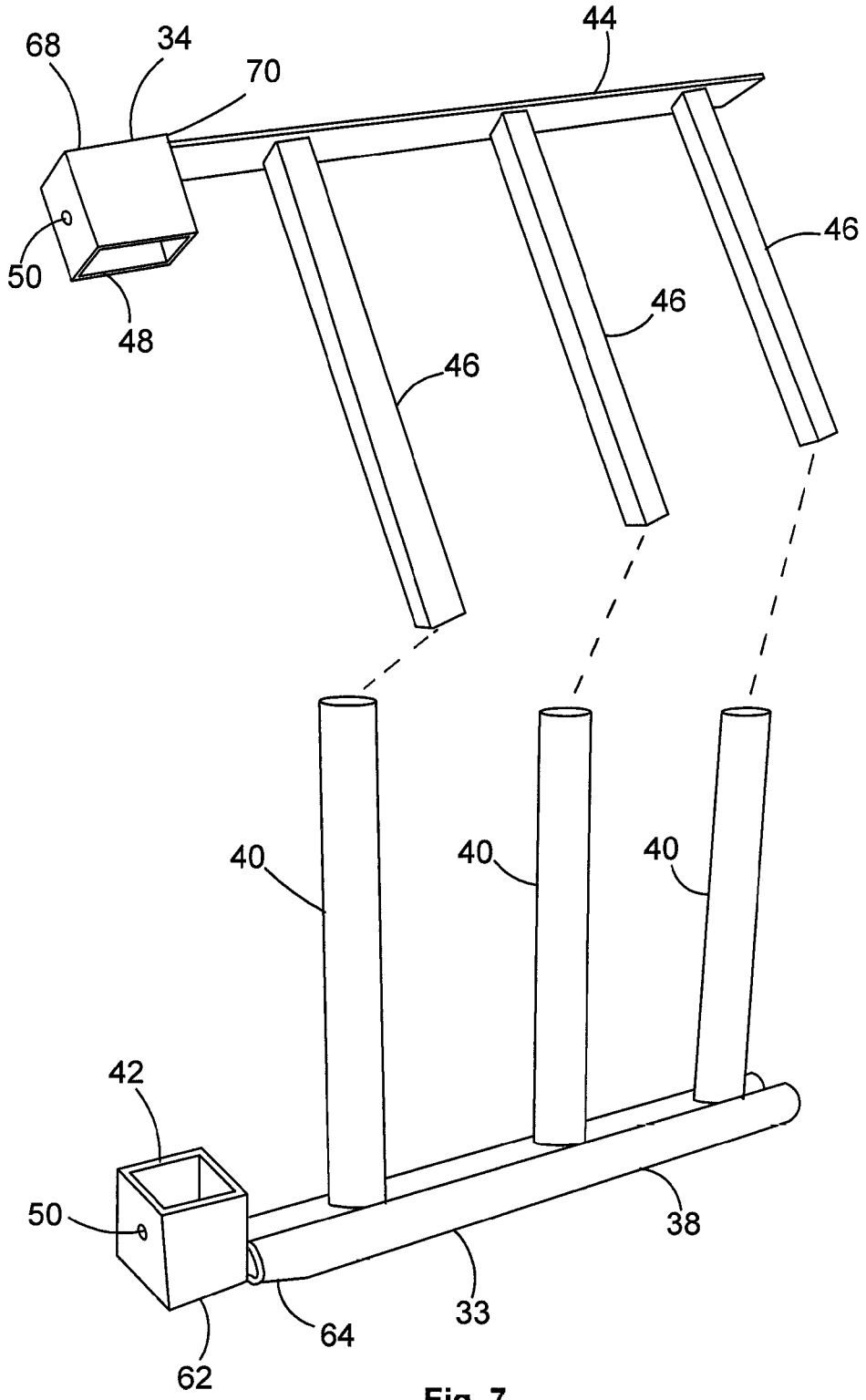
FIG. 7 shows the components in FIG. 6 disengaged.

A variety of weight configurations may be used in this invention. The version shown in FIG. 3 is a preferred configuration. The weight 26 is made by filling a polyethylene container with a concrete slurry and allowing it to set. It weighs approximately 15 kg. The weight has a generally rectangular shape in plan view and has an elongated hole 60 vertically through it. The hole's elongation is lateral to the rectangular weight when looking down. The weight's bottom surface 52 has a wide lateral channel 54 so the weight 26 can sit astride the base member 38 and its bottom surface 52 still bear on the ground each side of the base member. The weight's top surface 55 has a central raised lateral plateau 56 which nests into the underside lateral channel 54 of a like weight stacked onto it. Ridges 58 and a raised land 59 on the top surface 55 also nest into corresponding hollows (not shown) on the bottom surface 52.

To erect the hoarding 10, a pair of base frames 33 are positioned on the ground at the desired distance apart. The desired number of weights 26 are then stacked on each base frame, with three weights per layer. Four layers of weights, totaling 180 kg are shown in the footing 35 of the support assembly 14, five layers in the footing 36 of assembly 15 and six layers in the footing 37 of assembly 16. The upright members 40 pass through the holes 60 of the lower layers of weights. The upright members 40 do not extend above the top layer of weights and may not even reach the top one or two layers. The top frame 34 is then positioned so its descending members 46 enter the relevant holes 60 and slide telescopically into respective upright members 40. The hole 60 in each of the weights is therefore penetrated by one or both of an ascending member 40 or a descending member 46.

For each support assembly the lower end of a post 18 is slid through the fastening sleeves 48 and 42, the top member 44 is pressed down firmly onto the weights and respective self-drilling screws 49 fastened through holes 50 in the sleeves 48 and 42 into the post. The rails 21 are fastened by self-drilling screws 17 to the posts 18, 19 and 20 and the panels 23 and 24 are screwed to the rails 21 by self-drilling fasteners 25. The panels 22 on the other side of the hoarding are then screwed to the rails. In some embodiments of the invention the second layer of panels, being those corresponding to panel 22, are not required.

When the panels 23 and 24 are affixed, the screws 49 are inaccessible, so preventing unauthorized raising of the top frames and removal of weights from the hoarding. panels 23 and 24 are screwed to the Different heights of footings can be constructed using the same sized base frames 33 and top frames 34. In FIG. 1 the bottom frame could rise for nearly four layers of weights and the top frame extend down for nearly four layers of weights, so the telescoping overlap of members 40 and 46 in the tallest footing 37 would still be almost two layers deep.

With the flat top member 44 pressed flat against the top of the weights, the upper surface of each footing 35, 36 and 37 is relatively flat, when compared with the protrusions present in some of the prior art, which is aesthetically pleasing and also lends itself to covering neatly by a fabric cover or even a tabletop. The flat upper surface is made possible because sufficient strength is imparted to the structure because the lower ends of the descending members 46 are engaged with and supported by the upper ends of the upright members 40.

The invention can be seen as a leg or foot or base capable of being fitted with variable counterweights or blocks as required by the wind load to weight ratio and wind classification as outlined in the relevant standards and codes. The embodiment described with reference to FIG. 1 includes the essential design features for lower heights, but is adjustable to take higher counterweight loads to accommodate a higher fence or hoarding or sign medium and therefore higher wind loads.

The design is also aimed at ease of handling to allow rapid installation of a temporary fence or hoarding or signage whilst interlocking the counterweights to prevent accidental dislodgment or removal.

The twelve weights in assembly 14 provide a footing which weighs about 180 kg while the eighteen weights in assembly 16 provide a footing which weighs about 270 kg. Base frames and top frames having longer upright members 40 and/or longer descending members 46 would provide for higher stacks of weights and thus greater loads.

The weight of the footing can vary from about 180 kg to about 720 kg and has a medium weighted load of 540 kg. The dimensions of a footing are typically 750 mm×600 mm×720 mm.

However as an alternative to providing top frames 34 of different sizes and base frames 33 of different sizes, for additional weight requirements two support assemblies 14, 15 or 16 may be mounted one above the other attached to the same pole. To facilitate this the upper end 68 of the sleeve 48 extends only a small distance above the top face 69 of the top member 44 to form a raised lip 70 sufficient to provide for a solid weld between the lip 70 and the top face 69. In addition the lower end 62 of the sleeve 42 is raised above the bottom of the base member 38 in order to provide clearance for the raised lip 70 when a base member 38 bears down upon a top face 69 of an underlying support assembly. The base member 38 is chamfered adjacent the the lower end 62 to improve clearances when stacked in that manner.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge.

The claims defining the invention are as follows:

1. A weighted support assembly for supporting an upright post, said support assembly comprising:
   - a base frame comprising:
     - an elongate base member attached to the post and extending outwards from the post; and
     - a plurality of upright elongate members ascending from the base member;
   - a plurality of weights stacked in layers upon the base member; and
   - a top frame comprising:
     - an elongate top member attached to the post and extending outwards from the post above the base member; and
     - a plurality of elongate members descending from the top member;

wherein:
- said ascending members engage telescopically with corresponding said descending members, and
- each said weight defines a hole therethrough which is penetrated by at least one of said ascending or descending members.

2. A support assembly according to claim 1 wherein the top member lies against the upper layer of said layers of weights.

3. A support assembly according to claim 1 or 2 wherein said weights are stacked with the top of an underlying said weight nesting into the base of a respective weight immediately above.

4. A support assembly according to claim 1 wherein the extent of said telescopic engagement is such that a layer of weights may be added or removed from said stack to create a new upper layer of weights while still providing said telescopic engagement and for the top member to bear upon said new upper layer of weights.

5. A support assembly according to claim 1 wherein one end of said top frame comprises a hollow section end portion adapted to slide along said post.

6. A support assembly according to claim 5 wherein the elongate top member is releasably fastened rigidly to the post.

7. A support assembly according to claim 1 wherein the elongate base member is fastened rigidly to the post.

8. A support assembly according to claim 1 wherein said post comprises a square or rectangular hollow section steel member and one end of said base frame has a corresponding square or rectangular hollow section end portion which can slide along said post.

9. A support assembly according to claim 8 wherein the end portion is fastened to the post.

10. A temporary hoarding, sign or fence structure comprising a plurality of upright posts connected by a plurality of generally horizontal rails where attached to each post is a weighted support assembly according to claim 9.

11. A method of erecting a temporary structure which includes the steps of:
   - positioning a plurality of weighted support assemblies each according to claim 9,
   - securing a post to each respective said base frame and top frame, and fastening structural components to said posts.

* * * * *